US006664866B2

(12) United States Patent
Yoneda et al.

(10) Patent No.: US 6,664,866 B2
(45) Date of Patent: Dec. 16, 2003

(54) GENERATOR OF CIRCULARLY POLARIZED WAVE

(75) Inventors: Naofumi Yoneda, Tokyo (JP); Moriyasu Miyazaki, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/890,798

(22) PCT Filed: Dec. 8, 2000

(86) PCT No.: PCT/JP00/08689

§ 371 (c)(1),
(2), (4) Date: Aug. 6, 2001

(87) PCT Pub. No.: WO01/43219

PCT Pub. Date: Jun. 14, 2001

(65) Prior Publication Data

US 2002/0125968 A1 Sep. 12, 2002

(30) Foreign Application Priority Data

Dec. 10, 1999 (JP) ..... 11-351762

(51) Int. Cl.[7] ..... H01P 1/165
(52) U.S. Cl. ..... 333/21 A; 333/157
(58) Field of Search ..... 333/21 A, 208, 333/157

(56) References Cited

U.S. PATENT DOCUMENTS

| | | | | |
|---|---|---|---|---|
| 3,668,567 A | * | 6/1972 | Rosen | 333/117 |
| 3,857,112 A | * | 12/1974 | Epis | 333/21 A |
| 4,922,213 A | * | 5/1990 | Ghosh | 333/157 |
| 4,982,171 A | * | 1/1991 | Figlia et al. | 333/135 |
| 5,801,598 A | * | 9/1998 | Tantawi et al. | 333/22 R |

FOREIGN PATENT DOCUMENTS

| | | |
|---|---|---|
| JP | 4724250 | 10/1972 |
| JP | 5074955 | 6/1975 |
| JP | 5020824 | 7/1975 |
| JP | 5020825 | 7/1975 |
| JP | 50105246 | 8/1975 |
| JP | 50145052 | 11/1975 |
| JP | 53-141938 | 2/1978 |
| JP | A6184102 | 4/1986 |
| JP | U61116403 | 7/1986 |
| JP | A63269601 | 11/1988 |
| JP | A3167905 | 7/1991 |
| JP | A3220901 | 9/1991 |
| JP | 8-084002 A | 3/1996 |

OTHER PUBLICATIONS

Ishida et al., Trans. IECE, vol. 63–B, No. 9, pp. 908–915 (1980).

uher et al., Artech House, pp. 420–435 (1993).

Yoneda et al., IEEE MTT–SIMS Digest, pp. 1449–1452 (2000).

Yoneda et al., IECE Electronics Society Convention, C–2–69, p. 96, (2000).

* cited by examiner

*Primary Examiner*—James Cho
(74) *Attorney, Agent, or Firm*—Birch, Stewart, Kolasch & Birch, LLP

(57) ABSTRACT

The present invention aims at providing a circular waveguide polarizer with high performance and low cost. The circular waveguide polarizer is realized by arranging a plurality of side grooves 12 in a side wall of a circular waveguide 11 along the direction of a pipe axis C1 and by appropriately designing the number, spacing, radial depth, circumferential width, length in the pipe axis direction, and the like. According to this circular waveguide polarizer, disturbance is imparted to a section with a coarse electromagnetic field distribution in a transmission mode to create a phase delay, so that the amount of phase delay does not vary largely with a delicate change in width, depth and length of the side grooves 12. That is, there is little deterioration in characteristics caused by a machining error or the like, and hence it becomes possible to effect mass production and cost reductions.

17 Claims, 15 Drawing Sheets

PRIOR ART

GENERATOR OF CIRCULARLY POLARIZED WAVE

This application is the national phase under 35 U.S.C. §371 of PCT International Application No. PCT/JP00/08689 which has an International filing date of Dec. 8, 2000, which designated the United States of America and was not published in English.

TECHNICAL FIELD

The present invention relates to a circular waveguide polarizer to be used mainly in VHF band, UHF band, microwave band, and millimeter wave band.

BACKGROUND ART

FIG. 1 is a schematic configuration diagram of a conventional circular waveguide polarizer described, for example, in Proc. of The Institute of Electronics and Communication Engineers (published in September 1980, Vol. 63-B, No. 9, pp. 908–915). In the figure, reference numeral 1 denotes a circular waveguide, reference numeral 2 denotes a plurality of metallic posts inserted into the circular waveguide 1 through a side wall of the waveguide in pairs with respect to an axis C1 of the waveguide and arranged at predetermined certain intervals along the direction of the pipe axis C1 of the waveguide 1, and reference numeral P1 and P2 denote an input end and an output end, respectively. FIG. 2 is an explanatory diagram showing a conventional electromagnetic field distribution of a horizontally polarized wave and a vertically polarized wave.

The operation of the conventional circular waveguide polarizer will now be described.

It is here assumed that a linearly polarized wave in a frequency band f capable of being propagated through the circular waveguide 1 is propagated in a fundamental transmission mode (TE11 mode) through the circular waveguide 1 and is incident from the input end P1 in a 45° inclined state of its polarization plane from an insertion plane of the metallic posts 2 as shown in FIG. 1. At this time, the incident linearly polarized wave can be regarded as being a combined wave of a linearly polarized wave perpendicular to the insertion surfaces of the metallic posts 2 and a linearly polarized wave horizontal to the insertion plane of the metallic posts 2, both having been incident in phase. Polarization components perpendicular to the insertion plane of the metallic posts 2, as shown on the right-hand side in FIG. 2, pass through the circular waveguide 1 with little influence from the metallic posts 2 and are outputted from the output end P2 due to the fact that an electric field intersects the metallic posts perpendicularly. On the other hand, the passing phase of polarization components horizontal to the insertion plane of the metallic posts 2, as shown on the left-hand side in FIG. 2, is delayed due to the fact that the metallic posts 2 serve as a capacitive susceptance since a magnetic field intersects the metallic posts 2 perpendicularly.

Thus, in the circular waveguide polarizer shown in FIG. 1, the metallic posts 2 act as a capacitive susceptance for the polarization component which is horizontal to the insertion plane. Therefore, the number, spacing and insertion length of the metallic posts 2 are appropriately designed so that a passing phase difference between the polarization component outputted from the output end P2 and perpendicular to the insertion plane of the metallic posts 2 on the one hand and the polarization component outputted from the output end P2 and horizontal to the insertion plane of the metallic posts 2 on the other hand is 90°. Thus, there is obtained a circularly polarized wave as a combined wave of both polarization components outputted from the output end P2. Namely, the linearly polarized wave incident from the input end P1 is outputted as a circularly polarized wave from the output end P2.

In the conventional circular waveguide polarizer constructed as above, since the metallic posts 2 are projected into the circular waveguide 1, disturbance is imparted to a section with a dense electric field distribution within the circular waveguide 1, allowing a phase delay to occur. Thus, the phase delay quantity or the reflection quantity vary greatly with a delicate change in insertion quantity of the metallic posts 2 into the circular waveguide 1. Therefore, the adjustment to obtain a desired passing phase characteristic or a reflection amplitude characteristic requires much time and there has been the problem that mass production and cost reductions are difficult.

Moreover, since the metallic posts 2 are projected to a section with a dense electric field distribution within the circular waveguide 1, there has been the problem that electric power resistance and low loss characteristic required of the circular waveguide polarizer are impaired.

The present invention has been accomplished for solving the above-mentioned problems and it is an object of the present invention to provide a high-performance low-cost circular waveguide polarizer.

DISCLOSURE OF THE INVENTION

According to the present invention, a circular waveguide polarizer is provided with side grooves arranged in a side wall of a circular waveguide.

Therefore, by appropriately designing the number, spacing, radial depth, circumferential width, length in a pipe axis direction, and the like of such side grooves, it is possible to delay a passing phase of a polarization component perpendicular to the installation plane of the side grooves by 90° relative to a passing phase of a polarization component horizontal to the side groove installation plane. Thus, there is obtained an advantageous effect such that there can be realized a circular waveguide polarizer in which a linearly polarized wave incident from an input end is outputted as a circularly polarized wave from an output end.

Moreover, the side grooves are formed in the side wall of the circular waveguide and disturbance is imparted to a section with a coarse electromagnetic field distribution in a transmission mode (e.g., circular waveguide TE11 mode) to give a phase delay. Therefore, the amount of phase delay does not vary largely even with a delicate change in the width, depth and length of each side groove. That is, the deterioration in characteristics caused by a machining error for example is small and it becomes possible to effect mass production and the reduction of cost.

Further, since metallic projections such as metallic posts are not arranged in the circular waveguide, the circular waveguide polarizer has superior characteristics with respect to electric power resistance and loss.

In the circular waveguide polarizer according to the present invention, first to $n^{th}$ side grooves may be formed in a side wall of a circular waveguide, the side grooves are arranged along the pipe axis direction so as to be symmetrical with respect to a plane which divides the circular waveguide right and left into two.

With this arrangement, the circular waveguide polarizer displays improved reflection matching.

In the circular wave polarizer according to the present invention, first to $n^{th}$ side grooves may be formed in the side wall of the circular waveguide along the pipe axis direction so as to be symmetric with respect to a plane which divides the circular waveguide right and left into two, and further, $n+1^{th}$ to $2n^{th}$ side grooves may be formed in positions opposed to the first to $n^{th}$ side grooves with respect to the axis of the circular waveguide.

With this arrangement, it is possible to suppress the generation of higher-order modes, and the circular waveguide polarizer can operate with improved characteristics over a wide band.

In the circular waveguide polarizer according to the present invention, a first side groove may be formed in the side wall of the circular waveguide and a second side groove may be formed in a position opposed to the first side groove with respect to the axis of the circular waveguide.

With this arrangement, it is possible to suppress the generation of higher-order modes and there is obtained a large phase delay at a short pipe axis length, so that the circular waveguide polarizer can be downsized and can operate with improved characteristics over a wide band.

In the circular waveguide polarizer according to the present invention, a radial depth of each of the first and second side grooves may be gently varied in the pipe axis direction.

With this arrangement, it is possible to suppress the generation of higher-order modes and there is obtained a large phase delay at a short pipe axis length, so that the circular waveguide polarizer can be downsized and can operate with improved characteristics over a wide band.

In the circular waveguide polarizer according to the present invention, a radial depth of each of the first and second side grooves may be varied stepwise in the pipe axis direction.

With this arrangement, since machining processes is facilitated, the circular waveguide polarizer can be mass-produced and the cost thereof can be reduced.

In the circular waveguide polarizer according to the present invention, the side grooves may be rectangular in sectional shape which is defined by the pipe axis direction and the circumferential direction.

As a result, since machining becomes easier, the circular waveguide polarizer can be mass-produced and reduced in cost.

In the circular waveguide polarizer according to the present invention, the side grooves may be semicircular at both ends in sectional shape which is defined by the pipe axis direction and the circumferential direction.

As a result, it becomes easier to effect machining and the circular waveguide polarizer can be mass-produced and reduced in cost.

In the circular waveguide polarizer according to the present invention, the side grooves may be rectangular in section which is defined by the radial direction and the circumferential direction.

As a result, it becomes easier to effect machining and the circular waveguide polarizer can be mass-produced and reduced in cost.

In the circular waveguide polarizer according to the present invention, the side grooves may be semicircular in section which is defined by the radial direction and the circumferential direction.

As a result, it becomes easier to effect machining and the circular waveguide polarizer can be mass-produced and reduced in cost.

In the circular waveguide polarizer according to the present invention, the side grooves may be sectorial in section which is defined by the radial direction and the circumferential direction.

As a result, a large phase delay can be obtained while keeping small the outermost diameter of the circular waveguide polarizer, so that the circular waveguide polarizer can be made smaller in size.

In the circular waveguide polarizer according to the present invention, a dielectric material may be disposed within each side groove.

As a result, the volume of each side groove with respect to the electromagnetic field becomes larger equivalently, and there is obtained a large phase delay in the side grooves of a small physical size, so that the circular waveguide polarizer can be made smaller in size.

According to the present invention, a circular waveguide polarizer comprises: first to mth circular waveguides; and first to $M-1^{th}$ rectangular waveguides each inserted between the adjacent circular waveguides, the rectangular waveguides having long sides longer than the diameter of the circular waveguides and short sides shorter than the diameter of the circular waveguides.

Therefore, by appropriately designing the number, spacing, width, height, thickness, and the like of the rectangular waveguides, it is possible to delay a passing phase of a polarization component perpendicular to the wide sides of the rectangular waveguides by 90° relative to a passing phase of a polarization component horizontal to the wide sides of the rectangular waveguides. Thus, a linearly polarized wave incident from an input end can be outputted as a circularly polarized wave from an output end.

Furthermore, a passing phase difference between both phases is obtained by delaying the passing phase of the polarization component perpendicular to the wide sides of the rectangular waveguides and at the same time by advancing the passing phase of the polarization component horizontal to the wide sides. Therefore, there is obtained a large phase difference, i.e., 90°, at a short pipe axis length and thus the circular waveguide polarizer can be reduced in size.

In the circular waveguide polarizer according to the present invention, first to mth circular waveguides may be arranged coaxially and first to $m-1^{th}$ rectangular waveguides may be arranged so as to be symmetric with respect to a plane which divides the first to mth circular waveguides right and left into two.

With this arrangement, the circular waveguide polarizer displays improved reflection matching.

According to the present invention, a circular waveguide polarizer comprises: first to mth circular waveguides; and first to $M-1^{th}$ elliptical waveguides each inserted between the adjacent circular waveguides, the first to $m-1^{th}$ elliptical waveguides having a major axis longer than the diameter of the circular waveguides and a minor axis shorter than the diameter of the circular waveguides.

Therefore, by appropriately designing the number, spacing, diameter, thickness, and the like of the elliptical waveguides, it is possible to delay a passing phase of a polarization component perpendicular to the major axes of the elliptical waveguides by 90° with respect to a polarization component horizontal to the major axes of the elliptical waveguides. Thus, a linearly polarized wave incident from an input end can be outputted as a circularly polarized wave from an output end.

Furthermore, a passing phase difference is obtained by delaying the passing phase of the polarization component perpendicular to the major axes of the elliptical waveguides and by advancing the passing phase of the polarization component horizontal to the major axes of the elliptical waveguides. Therefore, it is possible to obtain a large phase delay at a short pipe axis length and effect reflection matching in a satisfactory manner. Thus, the circular waveguide polarizer can be reduced in size and can operate with improved characteristics over a wide band.

In the circular waveguide polarizer according to the present invention, first to $m^{th}$ circular waveguides may be arranged coaxially and first to $m-1^{th}$ elliptical waveguides may be arranged so as to be symmetrical with respect to a plane which divides the first to mth circular waveguides right and left into two.

With this arrangement, the circular waveguide polarizer can operate in good reflection matching.

BEST MODE FOR CARRYING OUT THE INVENTION

To describe the present invention in more detail, preferred embodiments of the invention will be described hereinunder with reference to the accompanying drawings.

First Embodiment

Figure 1:
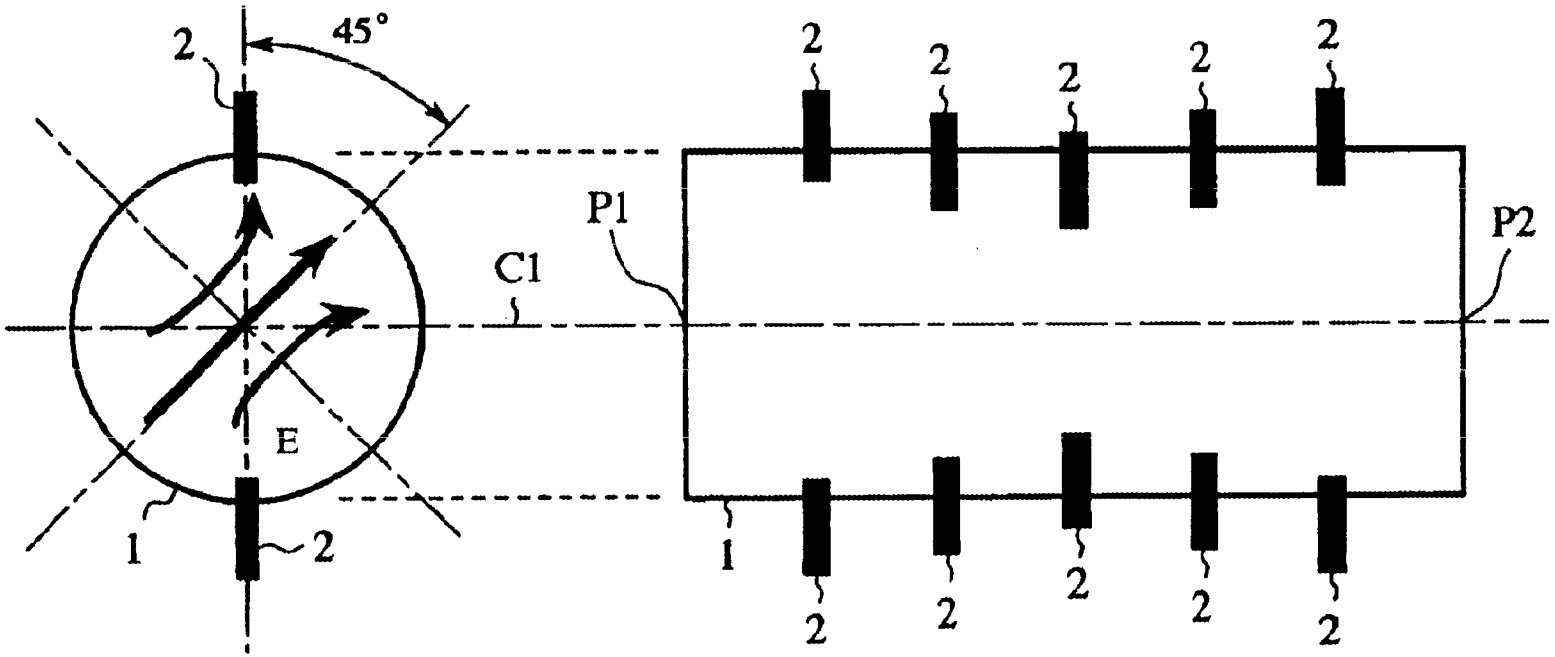
FIG. 1 is a schematic configuration diagram showing a conventional circular waveguide polarizer.
Figure 2:
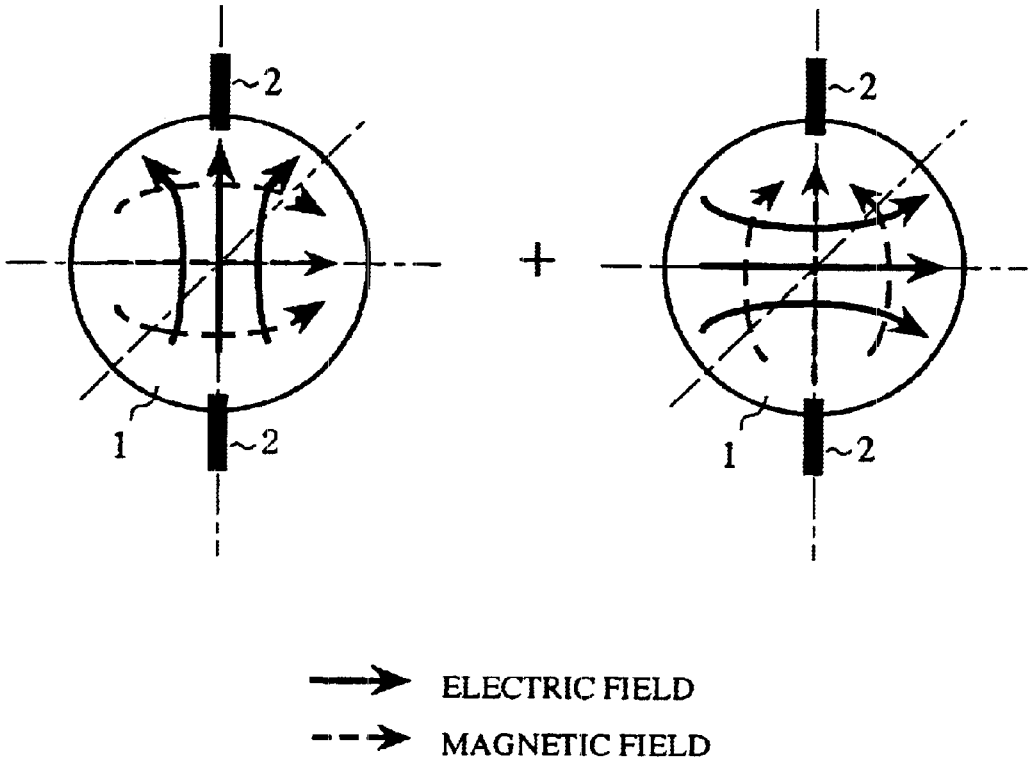
FIG.2 PRIOR ART
FIG. 2 is an explanatory diagram showing electromagnetic field distributions of a horizontally polarized wave and a vertically polarized wave in the conventional circular waveguide polarizer.
Figure 3:
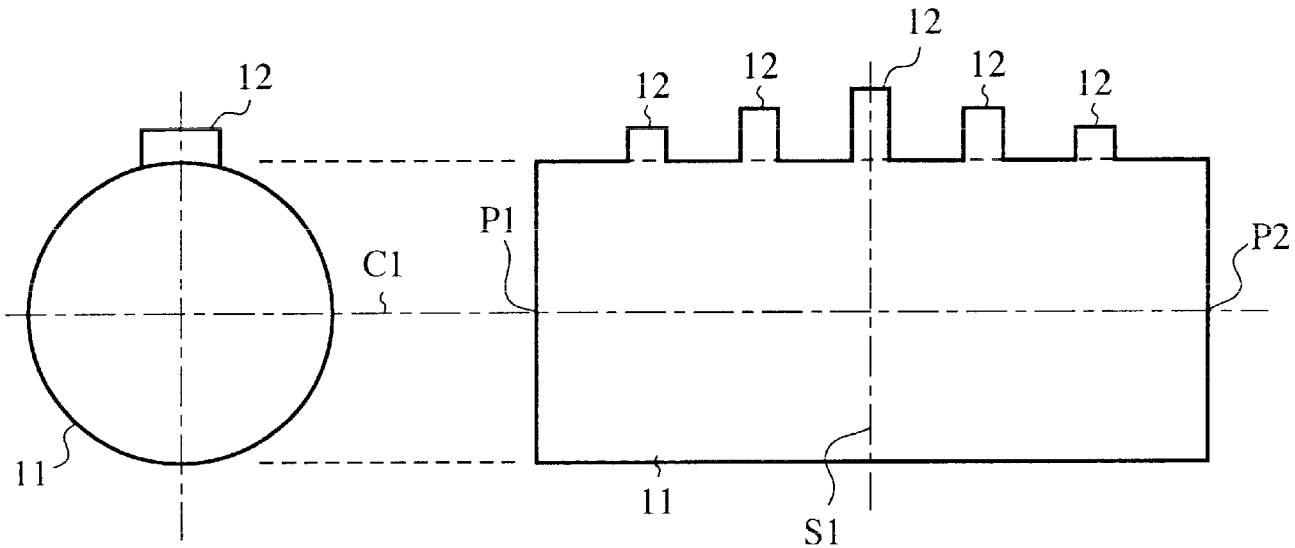
FIG. 3 is a schematic configuration diagram showing a circular waveguide polarizer according to a first embodiment of the present invention.
Figure 4:
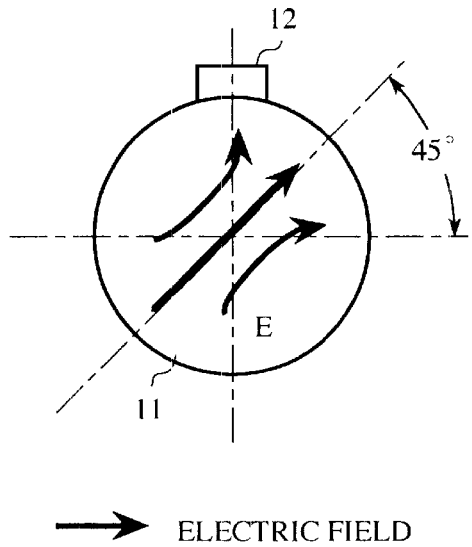
FIG. 4 is an explanatory diagram showing an electromagnetic field distribution of an incident wave in the first embodiment of the present invention.
Figure 5:
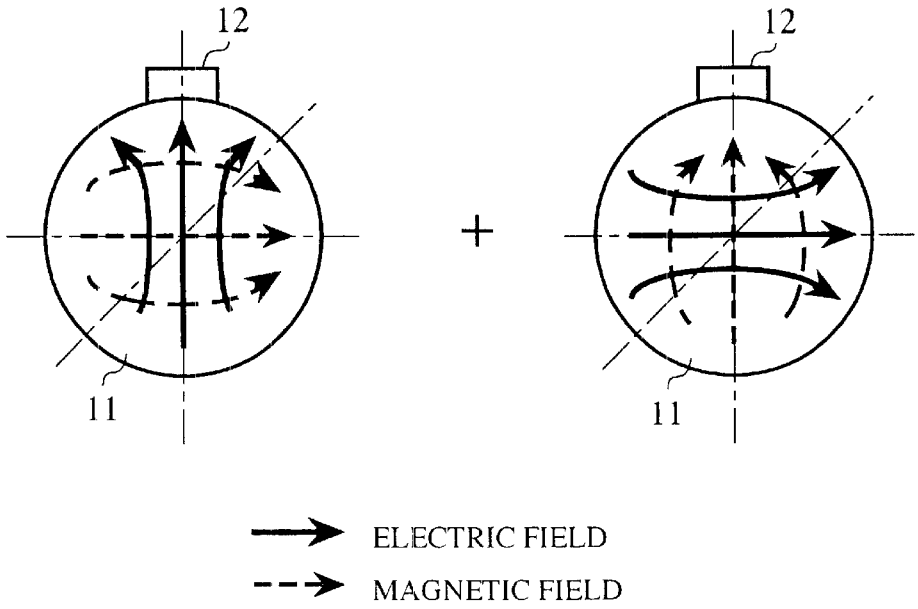
FIG. 5 is an explanatory diagram showing electromagnetic field distributions of a horizontally polarized wave and a vertically polarized wave in the first embodiment of the present invention.

FIG. 3 is a schematic configuration diagram showing a circular waveguide polarizer according to a first embodiment of the present invention. In the figure, reference numeral 11 denotes a circular waveguide, 12 denotes a plurality of side grooves formed in a side wall of the circular waveguide 11. The side grooves 12 are arranged along the direction of pipe axis C1 so as to be symmetric with respect to a plane S1 which divides the circular waveguide 11 right and left into two and so as to be large in volume at its center portion and smaller in volume toward an input end P1 and an output end P2. FIG. 4 is an explanatory diagram showing an electromagnetic field distribution of an incident wave in the first embodiment of the present invention, and FIG. 5 is an explanatory diagram showing electromagnetic field distributions of a horizontally polarized wave and a vertically polarized wave in the first embodiment of the present invention.

Next, the operation of this embodiment will be described below.

It is here assumed that a linearly polarized wave of a certain frequency band f capable of being propagated through the circular waveguide 11 has been propagated in a fundamental transmission mode (TE11 mode) of the circular waveguide and entered the waveguide from the input end P1 inclinedly while its polarization plane is inclined 45° from the installation plane of the plural side grooves 12, as shown in FIG. 4. At this time, as shown in FIG. 5, the incident linearly polarized wave can be regarded as a combined wave of a linearly polarized wave perpendicular to the installation plane of the side grooves 12 and a linearly polarized wave horizontal to the side grooves installation plane both having been incident in phase. As shown on the left-hand side in FIG. 5, the polarization component horizontal to the installation plane of the side grooves 12 passes through the circular waveguide 11 and is outputted from the output end P2 while being little influenced by the side grooves 12 because of a cut-off effect since the side grooves 12 are located at a position where an electric field enters horizontally. Turning now to the polarization component perpendicular to the installation plane of the side grooves 12, as shown on the right-hand side in FIG. 5, since the side grooves 12 are located at a position where an electric field enters perpendicularly, an intra-pipe wavelength is shortened equivalently under the influence of an electric field entering the side grooves 12. Thus, the passing phase in the circular waveguide 11 having the side grooves 12 is relatively delayed in comparison with the passing phase of the polarization component horizontal to the installation plane of the side grooves.

Thus, in this first embodiment, the circular waveguide 11 has the plural side grooves 12 formed in the side wall of the waveguide 11 and arranged along the direction of the pipe axis C1 so as to be symmetric with respect to the plane S1 which divides the waveguide 11 right and left into two. Therefore, by appropriately designing the number, spacing, radial depth, circumferential width, length in the pipe axis direction, and the like of the side grooves 12, the passing phase of the polarization component perpendicular to the installation plane of the side grooves 12 can be delayed 90° relative to the passing phase of the polarization component horizontal to the installation plane of the side grooves 12. Consequently, it is possible to realize a circular waveguide polarizer wherein a linearly polarized wave incident from the input end P1 is outputted as a circularly polarized wave from the output end P2. According to the conventional circular waveguide polarizer, the metallic posts 2 are inserted into the circular waveguide 1 and disturbance is imparted to a portion with a dense electromagnetic field distribution in a transmission mode (e.g., the circular waveguide TE11 mode) to create a phase delay. On the other hand, according to the circular waveguide polarizer of the first embodiment, grooves are formed into the side wall of the circular waveguide 11 and disturbance is given to a portion with a coarse electromagnetic field distribution in a transmission mode (e.g., the circular waveguide TE11 mode) to create a phase delay, so even with a delicate change in width, depth and length of the side grooves 12, the amount of phase delay does not vary largely. That is, there occurs little deterioration in characteristics caused by a machining error for example and it becomes possible to effect mass production or to reduce costs. Besides, since metallic projections such as metallic posts are not provided within the circular waveguide 11, the circular waveguide polarizer has superior characteristics with respect to electric power resistance and loss.

Further, since the plural side grooves 12 are arranged symmetrically with respect to the plane S1 so as to be large in volume centrally and smaller in volume toward the input and output ends P1, P2, there is obtained a good reflection matching.

Although five side grooves 12 are formed in the above first embodiment, the number of side grooves 12 may be changed according to a desired design. For example, it may be one, or first to $n^{th}$ (n is an integer of two or more) side grooves may be formed.

Second Embodiment

Figure 6:
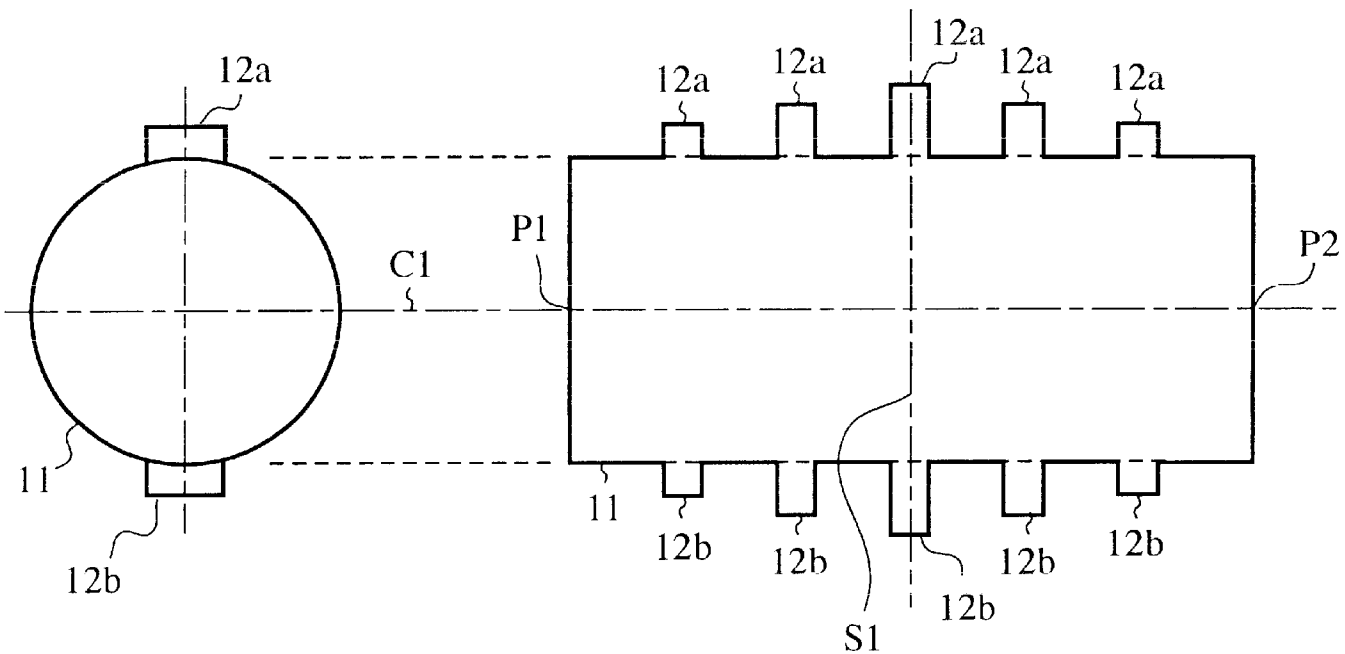
FIG. 6 is a schematic configuration diagram showing a circular waveguide polarizer according to a second embodiment of the present invention.

FIG. 6 is a schematic configuration diagram showing a circular waveguide polarizer according to a second embodiment of the present invention. In the figure, reference numeral 12*a* denotes a plurality of side grooves formed in a side wall of a circular waveguide 11 and arranged along the direction of pipe axis C1. The side grooves 12*a* are arranged so as to be symmetrical with respect to a plane S1 which divides the circular waveguide 11 right and left into two and so as to be large in volume at its center portion and smaller in volume toward an input end P1 and an output end P2. Reference numeral 12*b* denotes a plurality of side grooves formed in the side wall of the circular waveguide 11. The side grooves 12*b* are arranged symmetrically at positions opposed to the side grooves 12*a* with respect to the pipe axis C1 of the circular waveguide 11.

According to the second embodiment, as described above, since the side grooves 12*a* and 12*b* are formed in positions opposed to each other with respect to the pipe axis C1, it is possible to suppress the occurrence of higher-order modes such as TM01 mode which is a second higher-order mode and TE21 mode which is a third higher-order mode, and thus the circular waveguide polarizer of this embodiment can operate with improved characteristics over a wide band.

In this second embodiment, the side grooves 12*a* and 12*b* are each formed five, but according to a desired design, one or plural, from first to $n^{th}$ (n is an integer of 2 or more), side groves 12*a* may be formed, and also as to the side walls 12*b*, one or plural, from n+1 to $2n^{th}$, side grooves 12*b* may be formed.

Third Embodiment

Figure 7:
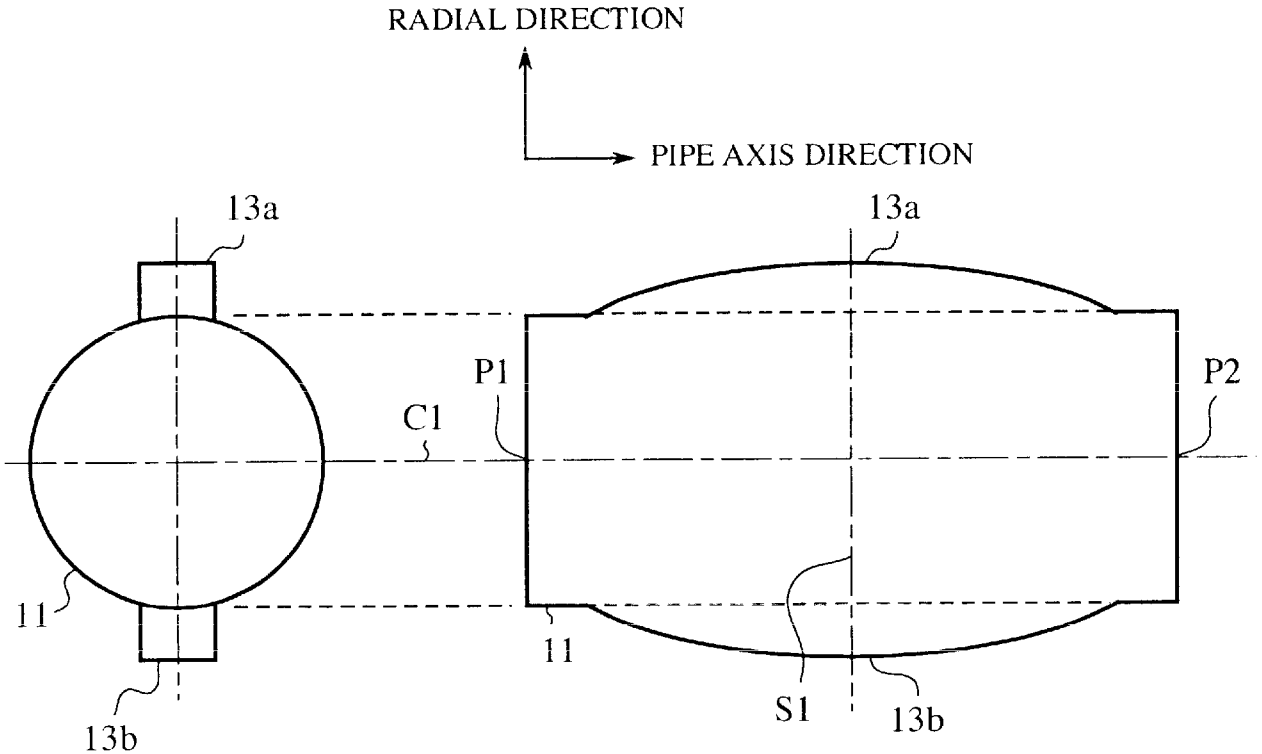
FIG. 7 is a schematic configuration diagram showing a circular waveguide polarizer according to a third embodiment of the present invention.

FIG. 7 is a schematic configuration diagram showing a circular waveguide polarizer according to a third embodiment of the present invention. In the figure, reference numeral 13*a* denotes a side groove (first side groove) formed in a side wall of a circular waveguide 11 so that a radial depth thereof is gently varied in the direction of a pipe axis C1. The side groove 13*a* is formed symmetrically with respect to a plane S1 which divides the circular waveguide right and left into two and in such a manner that the volume thereof is large centrally and becomes smaller toward an input end P1 and an output end P2. Reference numeral 13*b* denotes a side groove (second side groove) formed in the side wall of the circular waveguide 11 so that a radial depth thereof is gently varied in the direction of the pipe axis C1. The side groove 13*b* is arranged at a position opposed to the side groove 13*a* with respect to the pipe axis C1 of the circular waveguide 11 and symmetrically with the side groove 13*a*.

Thus, according to the third embodiment, each of the side grooves 13*a* and 13*b* is not divided, and has a large volume. Further, they are formed in positions opposed to each other with respect to the pipe axis C1, so that a large phase delay and a good reflection matching are obtained at a short pipe axis length. Consequently, the circular waveguide polarizer can be reduced in size and can operate with good characteristics over a wide band.

Fourth Embodiment

Figure 8:
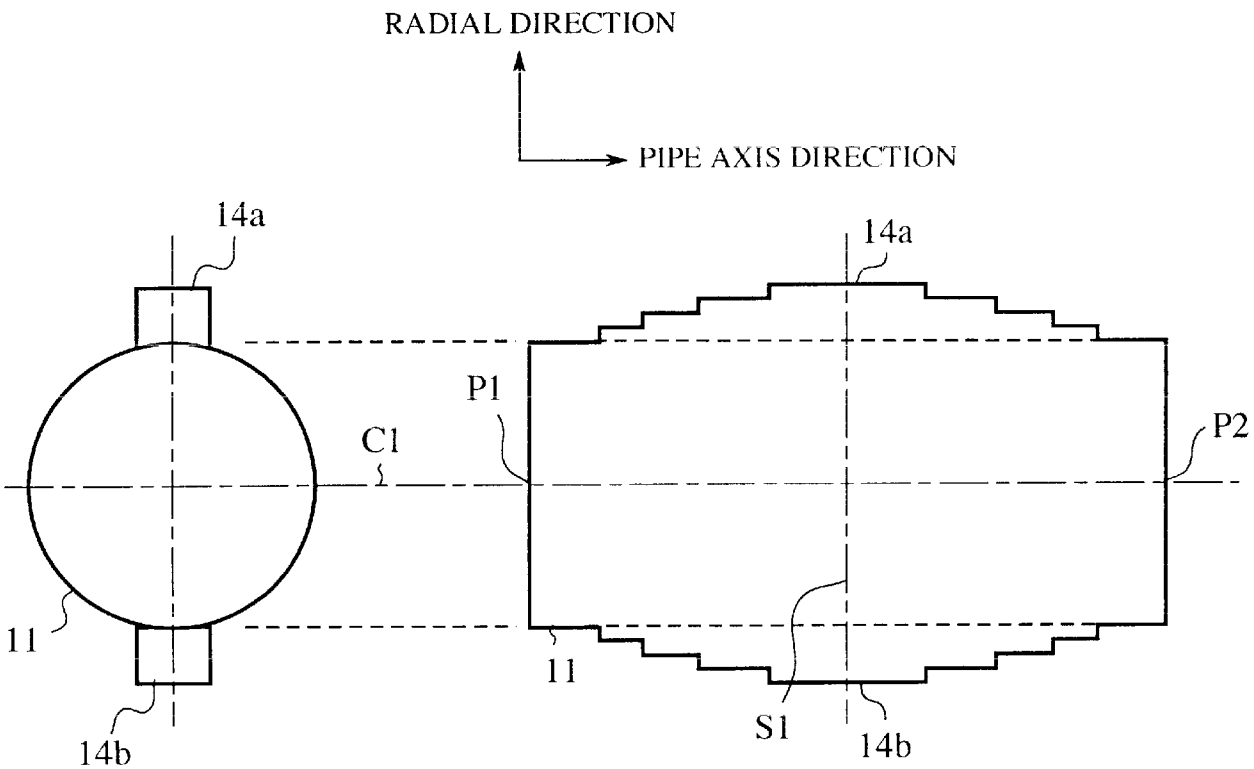
FIG. 8 is a schematic configuration diagram showing a circular waveguide polarizer according to a fourth embodiment of the present invention.

FIG. 8 is a schematic configuration diagram showing a circular waveguide polarizer according to a fourth embodiment of the present invention. In the figure, reference numeral 14*a* denotes a side groove (first side groove) formed in a side wall of a circular waveguide 11 so that a radial depth thereof varies stepwise along the direction of a pipe axis C1. The side groove 14*a* is formed symmetrically with respect to a plane S1 which divides the circular waveguide 11 right and left into two and in such a manner that the volume thereof is large centrally and becomes smaller toward an input end P1 and an output end P2. Reference numeral 14*b* denotes a side groove (second side groove) formed in the side wall of the circular waveguide 11 so that a radial depth thereof varies stepwise along the direction of the pipe axis C1. The side groove 14*b* is arranged symmetrically at a position opposed to the side groove 14*a* with respect to the pipe axis C1 of the circular waveguide 11.

Thus, according to the fourth embodiment, in addition to the advantageous effects of the circular waveguide polarizer in the previous third embodiment, advantageous effects such as facilitation of machining, mass production and cost reductions are obtained since the side grooves 14*a* and 14*b* are formed stepwise.

Fifth Embodiment

Figure 9:
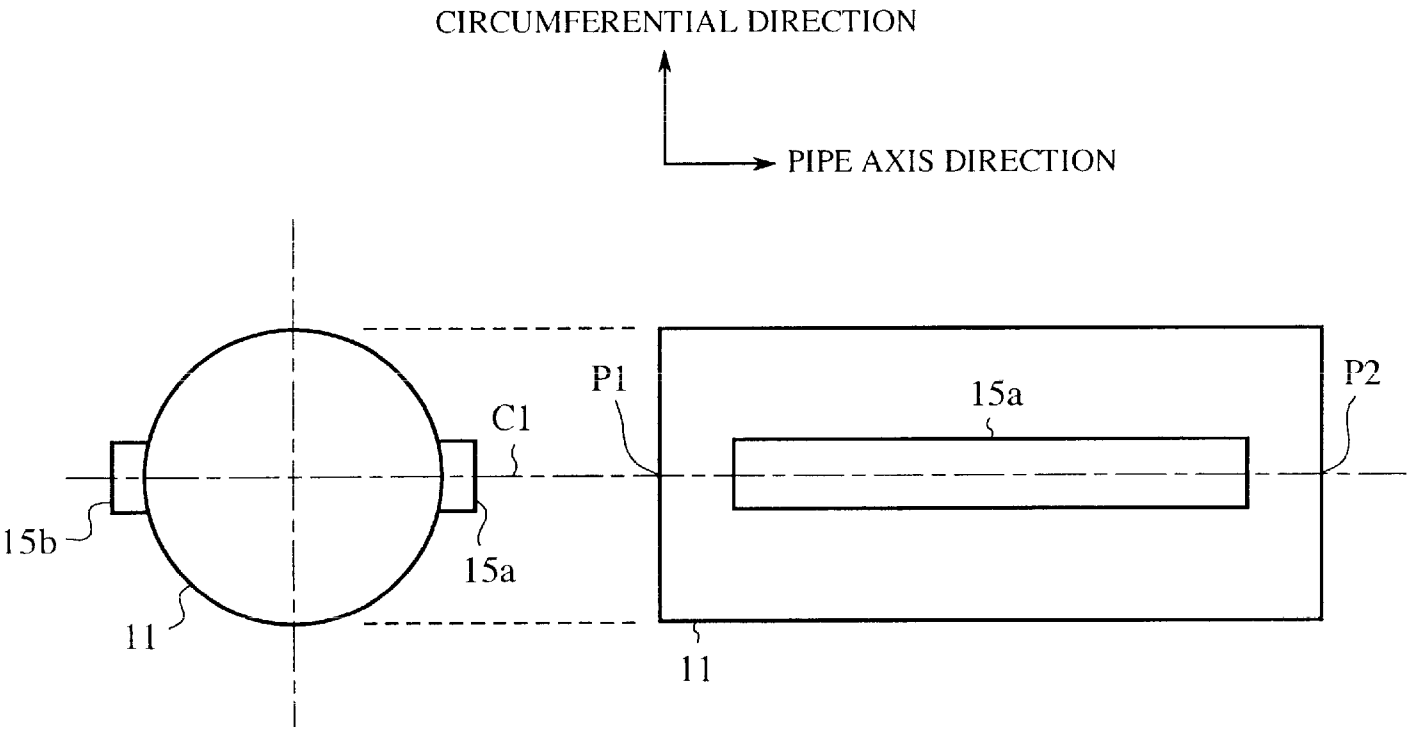
FIG. 9 is a schematic configuration diagram showing a circular waveguide polarizer according to a fifth embodiment of the present invention.

FIG. 9 is a schematic configuration diagram showing a circular waveguide polarizer according to a fifth embodiment of the present invention. In the figure, reference numerals 15*a* and 15*b* denote side grooves each having a rectangular shape in cross section as defined by the pipe axis C1 direction and the circumferential direction of a circular waveguide 11.

In the previous first to fourth embodiments, side grooves 12, or side grooves 12*a* and 12*b*, or side grooves 13*a* and 13*b*, or side grooves 14*a* and 14*b* are formed in the side wall of the circular waveguide 11. In the circular waveguide polarizer of the fifth embodiment, each side groove is formed so as to have a rectangular shape in section including the pipe axis C1 direction and the circumferential direction. As a result, advantageous effects such as facilitation of machining, mass production and cost reductions are obtained.

Sixth Embodiment

Figure 10:
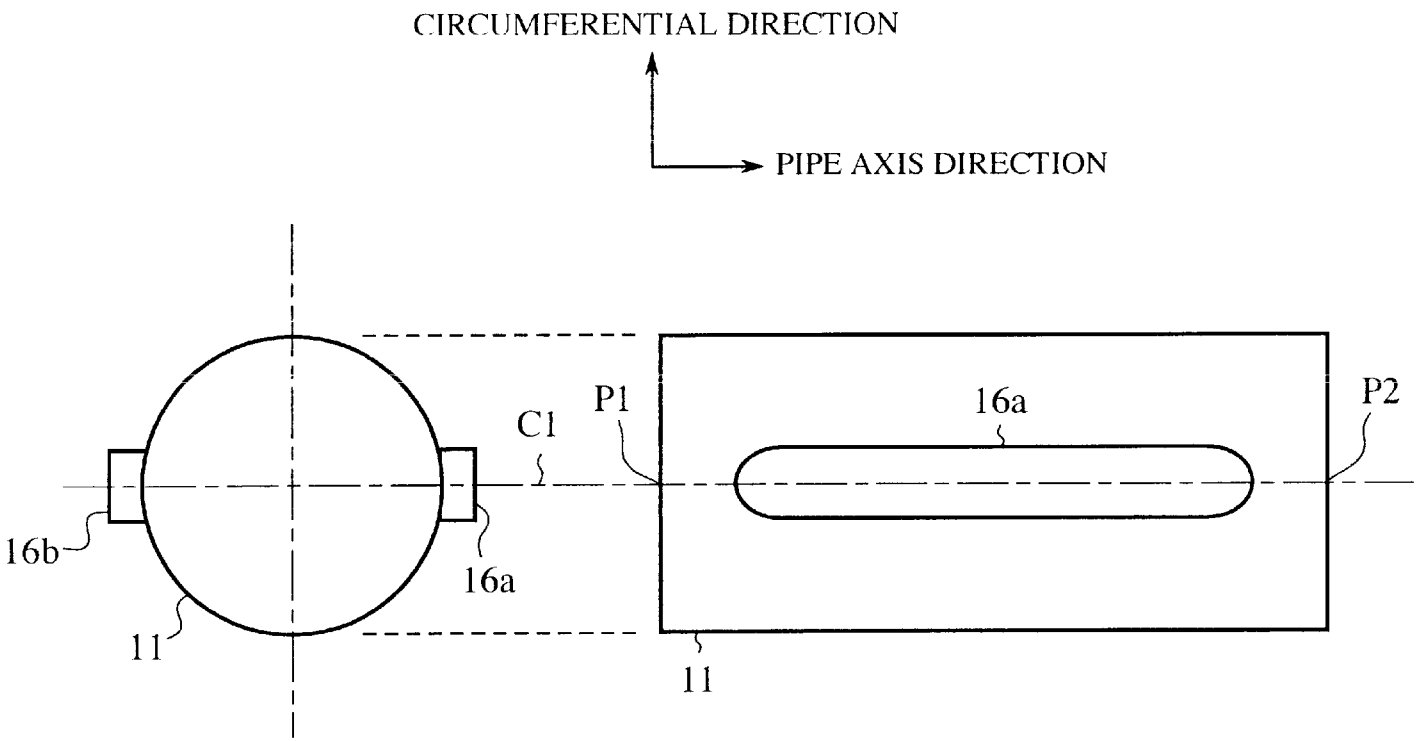
FIG. 10 is a schematic configuration diagram showing a circular waveguide polarizer according to a sixth embodiment of the present invention.

FIG. 10 is a schematic configuration diagram showing a circular waveguide polarizer according to a sixth embodiment of the present invention. In the figure, reference numeral 16*a* and 16*b* denote side grooves, both ends of which are formed in a semicircular shape in section as defined by the pipe axis C1 direction and the circumferential direction of a circular waveguide 11.

In the above first to fourth embodiments, side grooves 12, or side grooves 12*a* and 12*b*, or side grooves 13*a* and 13*b*, or side grooves 14*a* and 14*b*, are formed in the side wall of the circular waveguide 11. In the circular waveguide polarizer of the sixth embodiment, both ends of the side grooves have semicircular shape in cross section as defined by the pipe axis C1 direction and the circumferential direction. As a result, advantageous effects such as facilitation of drilling, mass production and cost reductions are obtained.

Seventh Embodiment

Figure 11:
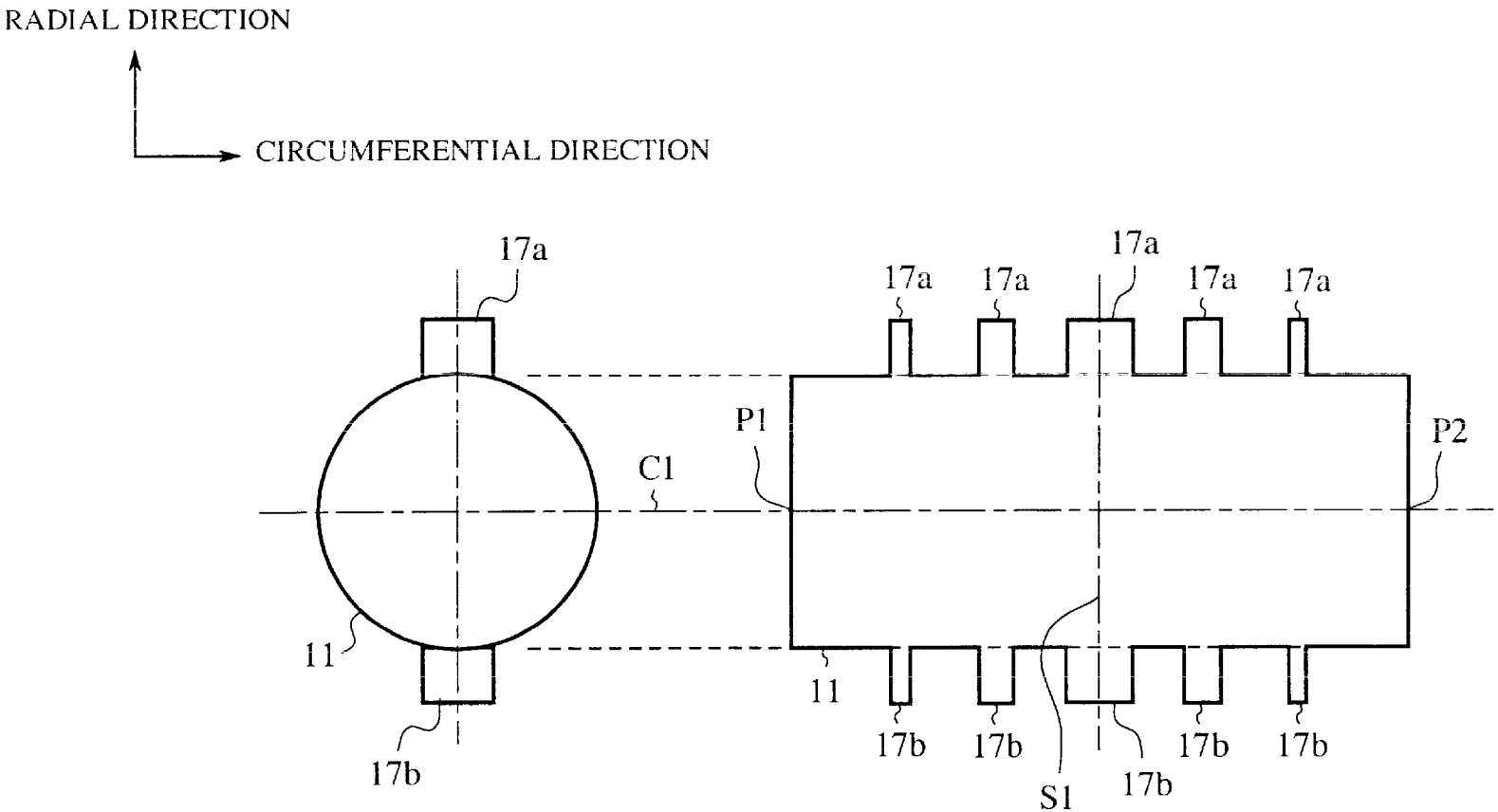
FIG. 11 is a schematic configuration diagram showing a circular waveguide polarizer according to a seventh embodiment of the present invention.

FIG. 11 is a schematic configuration diagram showing a circular waveguide polarizer according to a seventh embodiment of the present invention. In the figure, reference numerals 17*a* and 17*b* denote side grooves which are rectangular in section as defined by the radial direction and the circumferential direction of a circular waveguide 11. The side grooves 17*a* and 17*b* have the same radial depth, but are different in length in the direction of pipe axis C1. The side grooves 17*a* and 17*b* are arranged symmetrically with respect to a plane S1 which divide the circular waveguide 11 right and left into two and in such a manner that the volume thereof is large centrally and becomes smaller toward an input end P1 and an output end P2.

In the above first to fourth embodiments, side grooves 12, or side grooves 12*a* and 12*b*, or side grooves 13*a* and 13*b*, or side grooves 14*a* and 14*b*, are formed in the side wall of the circular waveguide 11. In the circular waveguide polarizer of the seventh embodiment illustrated in FIG. 11, the side grooves are formed rectangularly in section as defined by the radial and circumferential directions. As a result, advantageous effects such as facilitation of wire cutting, mass production and cost reductions are obtained. Moreover, since the length in the pipe axis C1 direction is changed without changing the radial depth of the circular waveguide 11, the volume of side grooves 17*a*, 17*b* can be enlarged even if the outermost diameter is set to a small value. As a result, since there is obtained a large phase delay, there can be made a further reduction of size.

Eighth Embodiment

Figure 12:
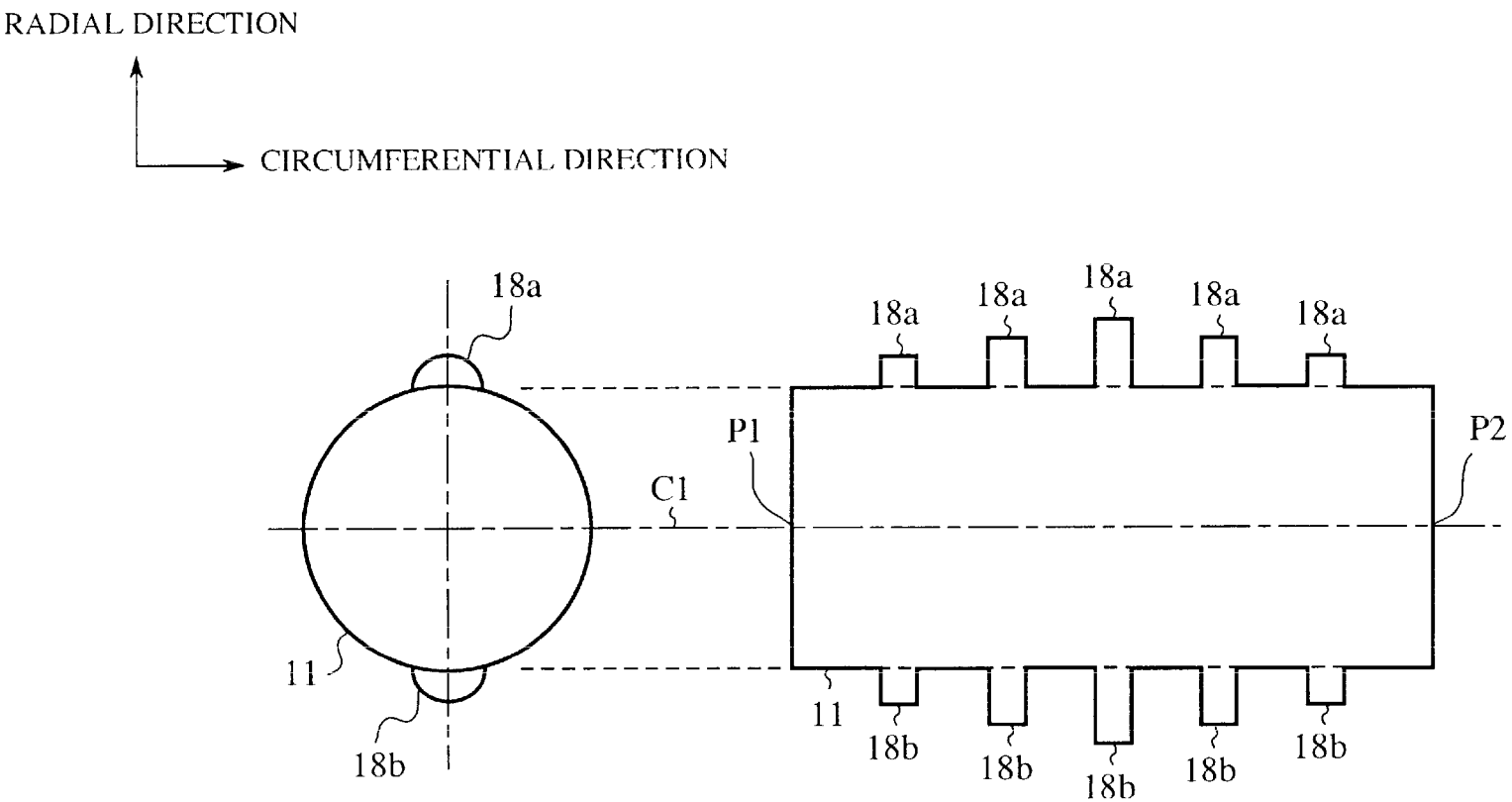
FIG. 12 is a schematic configuration diagram showing a circular waveguide polarizer according to an eighth embodiment of the present invention.

FIG. 12 is a schematic configuration diagram showing a circular waveguide polarizer according to an eighth embodiment of the present invention. In the figure, reference numerals 18*a* and 18*b* denote side grooves which are semicircular in section including the radial direction and the circumferential direction of a circular waveguide 11.

In the above first to fourth embodiments, side grooves 12, or side grooves 12*a* and 12*b*, or side grooves 13*a* and 13*b*, or side grooves 14*a* and 14*b*, are formed in the side wall of the circular waveguide 11. In the circular waveguide polarizer of the eighth embodiment, the side grooves are formed semicircularly in section as defined by the radial and circumferential directions of the circular waveguide. As a result, advantageous effects such as facilitation of drilling, mass production and cost reductions are obtained.

Ninth Embodiment

Figure 13:
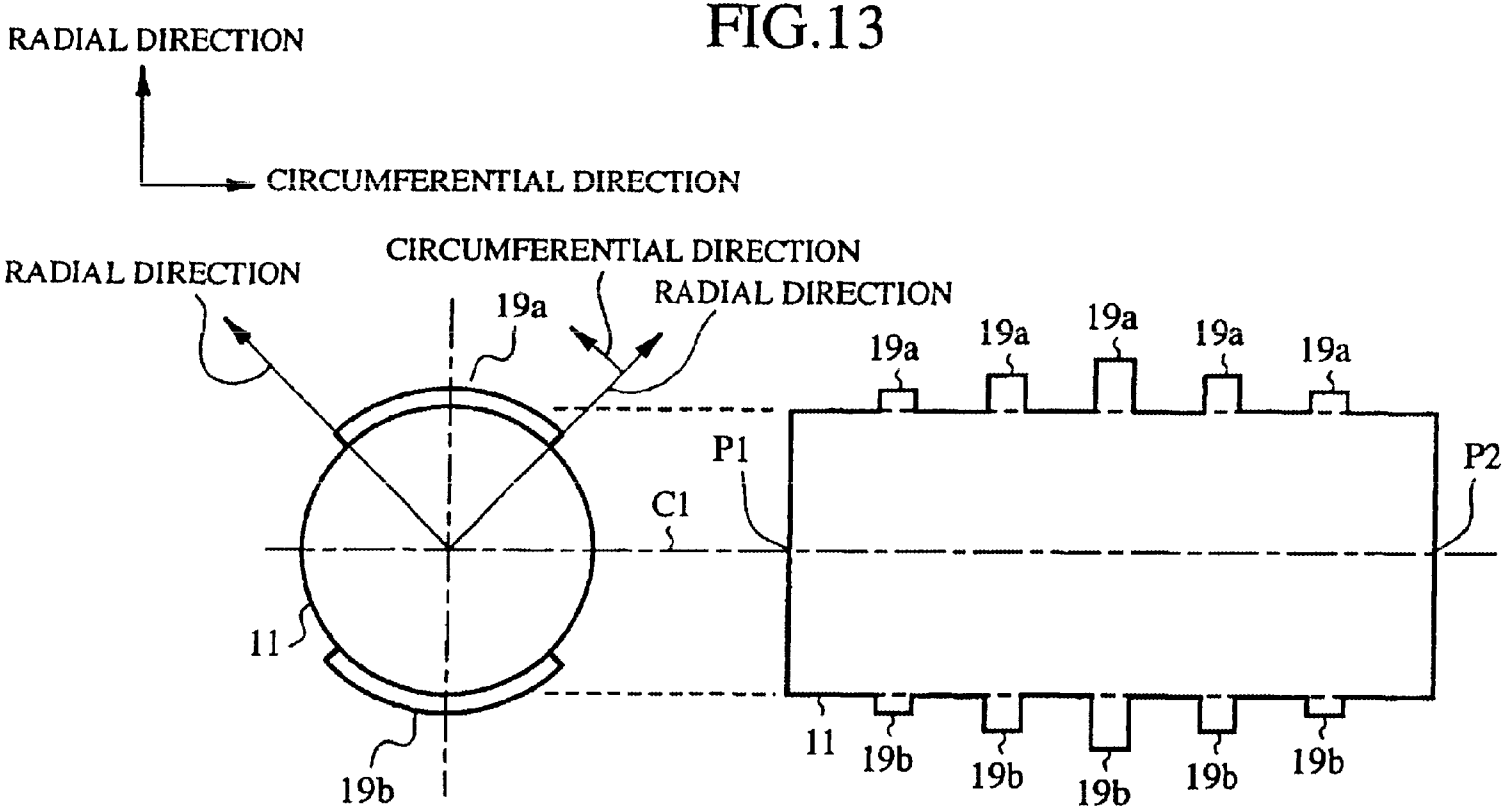
FIG. 13 is a schematic configuration diagram showing a circular waveguide polarizer according to a ninth embodiment of the present invention.

FIG. 13 is a schematic configuration diagram showing a circular waveguide polarizer according to a ninth embodiment of the present invention. In the figure, reference numerals 19*a* and 19*b* denote side grooves which are formed sectorially in section as defined by the radial and circumferential directions of a circular waveguide 11.

In the above first to fourth embodiments, side grooves 12, or side grooves 12*a* and 12*b*, or side grooves 13*a* and 13*b*, or side grooves 14*a* and 14*b*, are formed in the side wall of the circular waveguide 11. In the circular waveguide polarizer of the ninth embodiment, the side grooves are formed sectorially in section as defined by the radial and circumferential directions of the circular waveguide, whereby the side groove volume can be enlarged even if the outermost diameter is set small, and there is obtained a large phase delay, thus permitting a further reduction of size.

Tenth Embodiment

Figure 14:
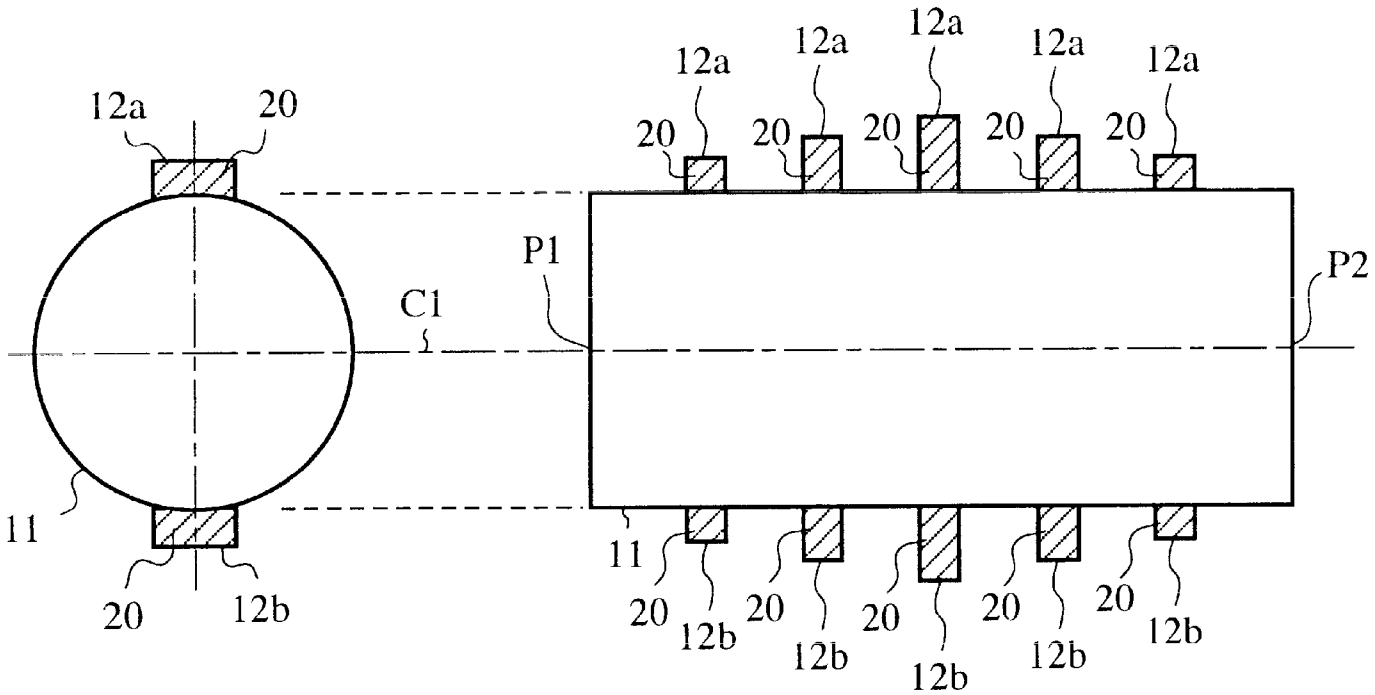
FIG. 14 is a schematic configuration diagram showing a circular waveguide polarizer according to a tenth embodiment of the present invention.

FIG. 14 is a schematic configuration diagram showing a circular waveguide polarizer according to a tenth embodiment of the present invention. In the figure, reference numeral 20 denotes a dielectric material inserted into each of side grooves 12*a* and 12*b*.

In the above first to fourth embodiments, side grooves 12, or side grooves 12*a* and 12*b*, or side grooves 13*a* and 13*b*, or side grooves 14*a* and 14*b*, are formed in the side wall of the circular waveguide 11. In the circular waveguide polarizer of the tenth embodiment, a dielectric material 20 is inserted into each of the side grooves, whereby the side groove volume with respect to the electromagnetic field becomes large equivalently and a large phase delay is obtained at a small physical size of side groove, thus permitting a further reduction of size.

Eleventh Embodiment

Figure 15:
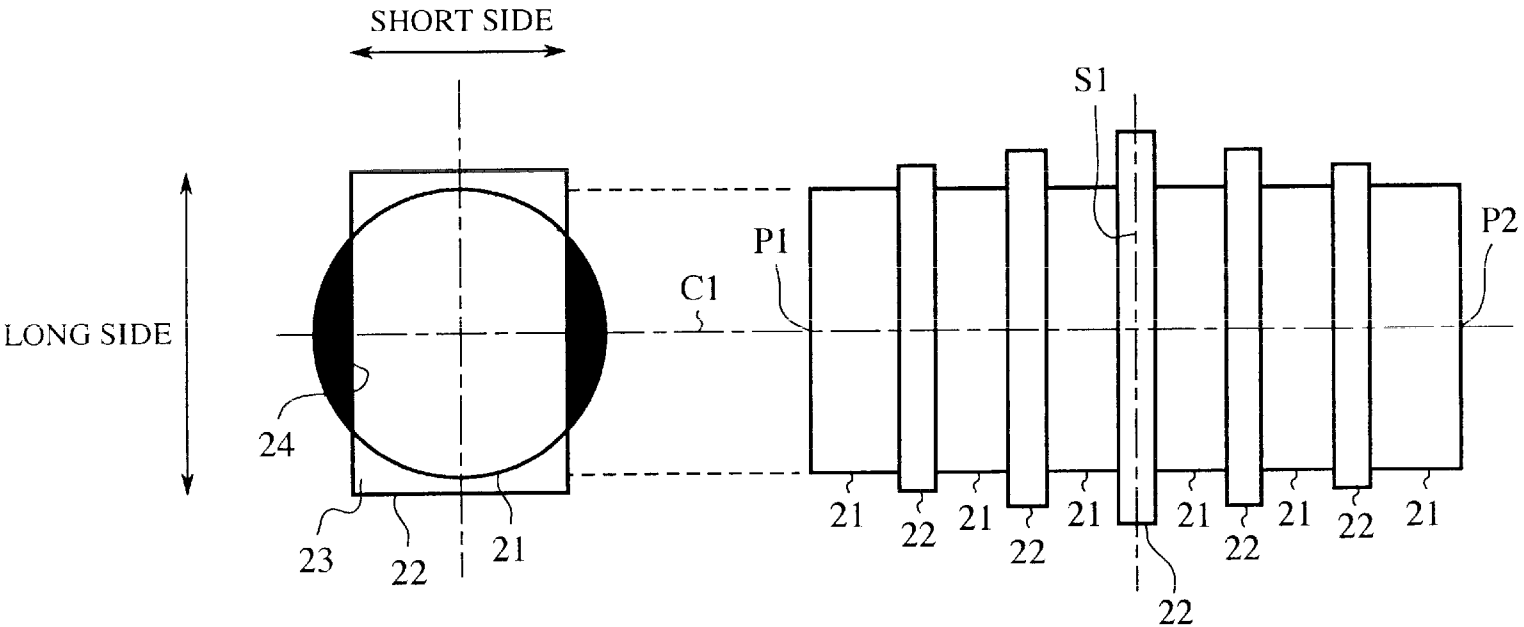
FIG. 15 is a schematic configuration diagram showing a circular waveguide polarizer according to an eleventh embodiment of the present invention.

FIG. 15 is a schematic configuration diagram showing a circular waveguide polarizer according to an eleventh embodiment of the present invention. In the figure, reference numeral 21 denotes a plurality of circular waveguides arranged coaxially, and reference numeral 22 denotes a plurality of rectangular waveguides each inserted between the adjacent circular waveguides 21 so as to afford a symmetrical structure with respect to a horizontal plane including an axis C1 of the circular waveguides 21.

By forming the plural rectangular waveguides 22 in such a manner that their long sides are each longer than the diameter of the circular waveguides 21 and their short sides are each shorter than the diameter of the circular waveguides 21, there are formed side grooves 23 and projections 24. Further, the rectangular waveguides 22 are installed so as to afford a symmetrical structure with respect to a plane S1 which divides the circular waveguides 21 right and left into two and in such a manner that the side grooves 23 are large in volume centrally and become smaller in volume toward an input end P1 and an output end P2.

Next, reference will be made below to the operation of the eleventh embodiment.

It is here assumed that a linearly polarized wave of a certain frequency band f capable of being propagated through the circular waveguide 21 has been propagated in a fundamental transmission mode (TE11 mode) of the circular waveguide 21 and entered the waveguide from the input end P1 while its polarization plane is inclined 45° from a wide sides of the plural rectangular waveguides 22. At this time, the incident linearly polarized wave can be regarded as a combined wave of a linearly polarized wave perpendicular to the wide sides of the rectangular waveguides and a linearly polarized wave horizontal to the wide sides. As to a polarization component horizontal to the wide sides of the rectangular waveguides 22, the side grooves 23 defined by the rectangular waveguides 22 are located in a position where an electric field enters horizontally, and the projections 24 also defined by the rectangular waveguides 22 are located in a position where a magnetic field pierces the projections 24 perpendicularly. Therefore the polarization component is little influenced by the side grooves 23 due to a cut-off effect. But an intra-pipe wavelength becomes long equivalently because the electromagnetic field is shifted to the inside of the circular waveguide 21 under the influence of the projections 24. And the polarization component passes through the circular waveguide 21 while the passing phase advances and is outputted from the output end P2. On the other hand, as to a polarization component perpendicular to the wide sides of the rectangular waveguides 22, the side grooves 23 defined by the rectangular waveguides 22 are located in a position where an electric field enters perpendicularly and the projections 24 also defined by the rectangular waveguide 22 are located in a position where an electric field pierces the projections 24 perpendicularly. Therefore, the intra-pipe wavelength becomes short equivalently because the electromagnetic field enters the side grooves 23 although there is little influence of the projections 24. And the polarization component passes through the circular waveguides 21 while the passing phase is delayed and is outputted from the output end P2.

Thus, in the eleventh embodiment, there are used a plurality of circular waveguides 21 arranged coaxially and a plurality of rectangular waveguides 22 each inserted between the adjacent circular waveguides 21 so as to be symmetric with respect to a horizontal plane including the axis C1 of the circular waveguide 21. Therefore, by appropriately designing the number, spacing, width, height, thickness, and the like of the rectangular waveguides 22, the passing phase of the polarization component perpendicular to the wide sides of the rectangular waveguides 22 can be delayed 90° with respect to the passing phase of the polarization component horizontal to the wide sides of the rectangular waveguides 22. Further, it is possible to realize a circular waveguide polarizer in which a linearly polarized wave incident from the input end P1 is outputted as a circularly polarized wave from the output end P2. According to the conventional circular waveguide polarizer, the metallic posts 2 are inserted into the circular waveguide 1 and the passing phase of the polarization component horizontal to the insertion plane of the metallic posts 2 is delayed, whereby there is obtained a phase difference from the polarization component perpendicular to the insertion plane of the metallic posts 2. On the other hand, according to the circular waveguide polarizer of the eleventh embodiment, the passing phase of the polarization component perpendicular to the wide sides of the rectangular waveguides 22 is delayed and at the same time the passing phase of the polarization component horizontal to the wide sides of the rectangular waveguides 22 is advanced, whereby there is obtained a passing phase difference between the two. Consequently, a large phase difference, namely, a phase difference of 90°, is obtained at a short pipe axis length. Thus, there accrues an advantageous effect that a small-sized circular waveguide polarizer is obtained.

Moreover, since the plural side grooves 23 are arranged symmetrically with respect to the plane S1 so as to be large in volume centrally and become smaller in volume toward the input and output ends P1, P2, there accrues an advantageous effect that an improved reflection matching is obtained.

Although in the eleventh embodiment there are used six circular waveguides 21 and five rectangular waveguides 22, the number of the circular waveguides 21 may be changed according to design requirements. For example, first to $m^{th}$ (m is an integer of 2 or more) circular waveguides 21 may be installed. In this case, as to the rectangular waveguides 22, first to $m-1^{th}$ of such rectangular waveguides may be installed.

Although the eleventh embodiment is constructed such that the long side of each rectangular waveguides 22 is longer than the diameter of each circular waveguide 21 and the short side thereof is shorter than the diameter of each circular waveguide 21, this may be changed according to design requirements. For example, the short side of each rectangular waveguide 22 may be set equal to the diameter of each circular waveguide 21. In this case, the projections 24 cannot be formed although the side grooves 23 can be formed. Therefore, the effect of reduction in size by the projections 24 is not obtained, but there is obtained a circular waveguide polarizer permitting mass production or cost reductions and superior in electric power resistance or low loss characteristics.

Twelfth Embodiment

Figure 16:
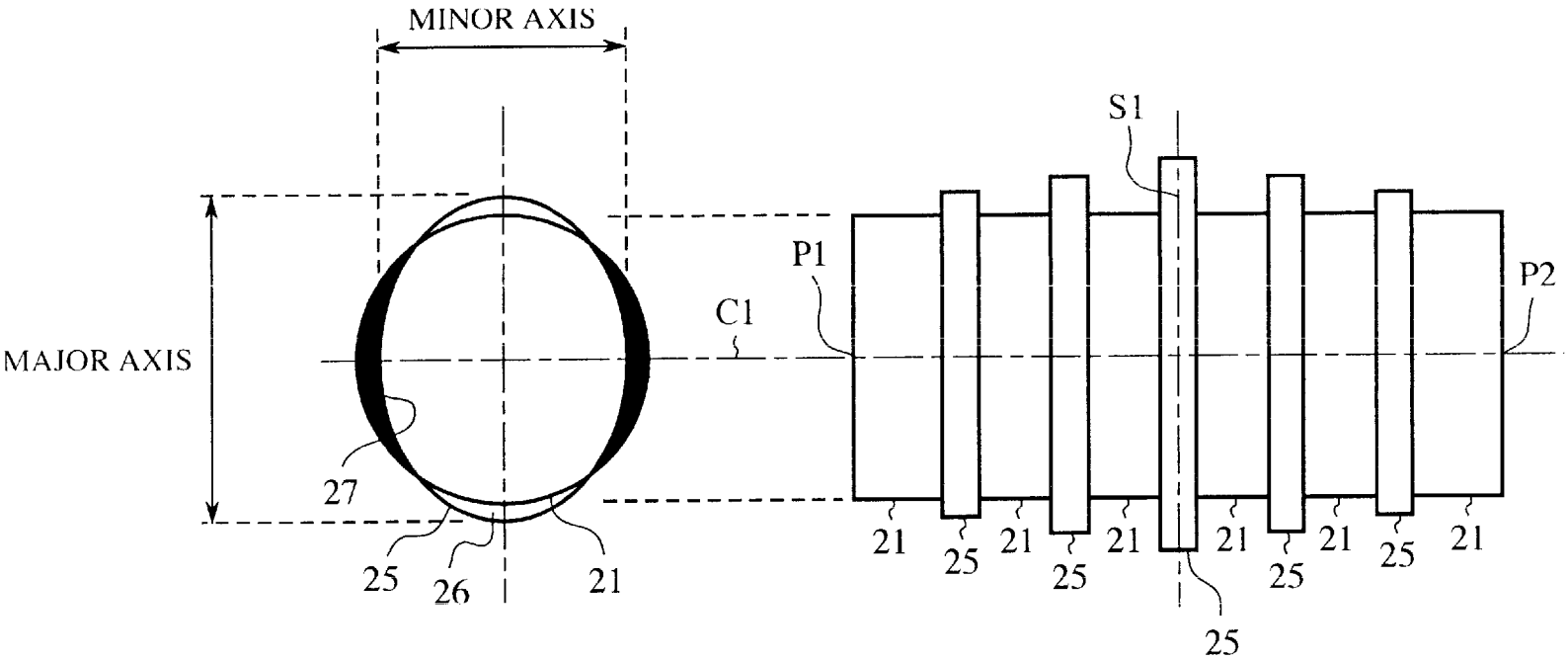
FIG. 16 is a schematic configuration diagram showing a circular waveguide polarizer according to a twelfth embodiment of the present invention.

FIG. 16 is a schematic configuration diagram showing a circular waveguide polarizer according to a twelfth embodiment of the present invention. In the figure, reference numeral 21 denotes a plurality of circular waveguides, and reference numeral 25 denotes a plurality of elliptical waveguides each inserted between the adjacent circular waveguides 21 so as to be symmetrical with respect to a horizontal plane including a pipe axis C1 of the circular waveguides 21.

The plural elliptical waveguides 25 are formed so as to be longer in the major axis and shorter in the minor axis than the diameter of each circular waveguide 21. Thus, the side grooves 26 and projections 27 are formed so as to be symmetrical with respect to a plane S1 which divides the circular waveguides 21 right and left into two and so that the side grooves 26 are large in volume centrally and become smaller in volume toward an input end P1 and an output end P2.

In the previous eleventh embodiment, the plural rectangular waveguides 22 are installed alternately with the circular waveguides 21 so as to give a symmetrical structure with respect to the horizontal plane including the axis C1 of the circular waveguides 21. But in the twelfth embodiment the plural elliptical waveguides 25 are installed alternately with the circular waveguides 21 so as to give a symmetrical structure with respect to the horizontal plane including the pipe axis C1, whereby there is obtained the same advantageous effect as in the eleventh embodiment.

Industrial Applicability

As described above, the present invention is suitable for a circular waveguide polarizer with high performance and low cost, which is mainly used in VHF, UHF, microwave, and millimeter wave bands.

What is claimed is:

1. A circular waveguide polarizer to make a circularly polarized wave from a linearly polarized wave in which a phase delay is given by a disturbance imparted to a section with a coarse electromagnetic field distribution in a transmission mode, wherein said disturbance is imparted by widening of portions of a side wall of the circular waveguide forming non-circular cross-sections defined by the widened portions and un-widened portions; and the widening of a portion of a side wall defined by radial and circumferential directions, wherein two radial directions define an angle corresponding to the smallest distance between the two radial directions, and where the angle does not exceed 45 degrees.

2. The circular waveguide polarizer according to claim 1, having one or plural side grooves in the side wall of a circular waveguide.

3. The circular waveguide polarizer according to claim 2, including first to $n^{th}$ (n is an integer of 2 or more) side grooves arranged in the side wall of the circular waveguide along a pipe axis direction of the circular waveguide so as to give a symmetrical structure with respect to a plane which divides the circular waveguide right and left into two.

4. The circular waveguide polarizer according to claim 2, including: first to $n^{th}$ side grooves arranged in the side wall of the circular waveguide along a pipe axis direction of the circular waveguide so as to give a symmetrical structure with respect to a plane which divides the circular waveguide right and left into two; and $n+1^{th}$ to $2n^{th}$ side grooves arranged in positions opposed to the respective first to $n^{th}$ side grooves with respect to the pipe axis of the circular waveguide.

5. The circular waveguide polarizer according to claim 2, including a first side groove arranged in the side wall of the circular waveguide and a second side groove arranged in a position opposed to the first side groove with respect to a pipe axis of the circular waveguide.

6. The circular waveguide polarizer according to claim 5, wherein radial depths of the first and second side grooves are gently varied in the pipe axis direction.

7. The circular waveguide polarizer according to claim 5, wherein radial depths of the first and second side grooves are varied stepwise in the pipe axis direction.

8. The circular waveguide polarizer according to claim 2, including first and second side grooves, or first to $n^{th}$ side grooves, or first to $2n^{th}$ side grooves, all or any of said side grooves being rectangular in section defined by a pipe axis direction and a circumferential direction of the circular waveguide.

9. The circular waveguide polarizer according to claim 2, including first and second side grooves, or first to $n^{th}$ side grooves, or first to $2n^{th}$ side grooves, all or any of said side grooves being semicircular, at both ends, in section as defined by a pipe axis direction and a circumferential direction of the circular waveguide.

10. The circular waveguide polarizer according to claim 2, including first and second side grooves, or first to $n^{th}$ side grooves, or first to $2n^{th}$ side grooves, all or any of said side grooves being rectangular in section defined by a radial direction and a circumferential direction of the circular waveguide.

11. The circular waveguide polarizer according to claim 2, including first and second side grooves, or first to $n^{th}$ side grooves, or first to $2n^{th}$ side grooves, all or any of said side grooves being semicircular in section defined by a radial direction and a circumferential direction of the circular waveguide.

12. The circular waveguide polarizer according to claim 2, including first and second side grooves, or first to $n^{th}$ side grooves, or first to $2n^{th}$ side grooves, all or any of said side grooves being sectorial in section defined by a radial direction and a circumferential direction of the circular waveguide.

13. The circular waveguide polarizer according to claim 2, including first and second side grooves, or first to $n^{th}$ side grooves, or first to $2n^{th}$ side grooves, with a dielectric material being arranged in all or any of said side grooves.

14. A circular waveguide polarizer according to claim 1, having first to $m^{th}$ (m is an integer of 2 or more) circular waveguides, and first to $m-1^{th}$ rectangular waveguides each inserted between adjacent ones of said first to $m^{th}$ circular waveguides and each having long and short sides longer and shorter respectively than the diameter of said circular waveguides.

15. The circular waveguide polarizer according to claim 14, wherein said first to $m^{th}$ circular waveguides are arranged coaxially and said first to $m-1^{th}$ rectangular waveguides are arranged so as to give a symmetrical structure with respect to a plane which divides the first to $m^{th}$ circular waveguides right and left into two.

16. A circular waveguide polarizer according to claim 1, having first to $m^{th}$ circular waveguides; and first to $m-1^{th}$ elliptical waveguides each inserted between adjacent ones of said first to $m^{th}$ circular waveguides and each having major and minor axes longer and shorter respectively than the diameter of said circular waveguides.

17. The circular waveguide polarizer according to claim 16, wherein said first to $m^{th}$ circular waveguides are arranged coaxially and said first to $m-1^{th}$ elliptical waveguides are arranged so as to give a symmetrical structure with respect to a plane which divides the first to $m^{th}$ circular waveguides right and left into two.

* * * * *